United States Patent [19]

Dooley

[11] 4,388,519

[45] Jun. 14, 1983

[54] NOISE ISOLATION MEANS FOR CONVOLUTED SHEATHED ELECTRIC HEATER

[75] Inventor: James A. Dooley, Louisville, Ky.

[73] Assignee: General Electric Company, Louisville, Ky.

[21] Appl. No.: 344,854

[22] Filed: Feb. 1, 1982

[51] Int. Cl.[3] ..... H05B 3/68

[52] U.S. Cl. ..... 219/463; 165/84; 174/42; 219/451; 219/459; 219/461; 219/536; 248/562; 248/68 CB

[58] Field of Search ..... 219/447, 451, 455, 456, 219/459, 460, 461, 462, 463, 464, 467, 532, 536, 538, 542; 310/93, 183; 174/42, 146, 147; 165/69, 84; 248/68 R, 68 CB, 562

[56] References Cited

U.S. PATENT DOCUMENTS

| | | | |
|---|---|---|---|
| 2,121,467 | 2/1964 | Bryant | 165/69 X |
| 2,271,977 | 2/1942 | Hjelmgren | 219/463 X |
| 2,404,531 | 7/1946 | Robertson | 248/68 CB |
| 2,548,183 | 4/1951 | Walton et al. | 219/463 |
| 2,624,827 | 1/1953 | Young | 219/463 |
| 2,662,157 | 12/1953 | Vallorani | 219/463 |
| 2,662,158 | 12/1953 | Vallorani | 219/463 X |
| 2,943,178 | 6/1960 | Aldous | 219/463 |
| 3,016,444 | 1/1962 | Jasionowski | 219/451 |
| 3,188,449 | 6/1965 | Hanson | 219/455 |
| 3,258,580 | 6/1966 | Dills | 219/463 |
| 3,327,966 | 6/1967 | Jasionowski | 248/205 |
| 3,345,498 | 10/1967 | Siegea | 219/464 |
| 3,348,025 | 10/1967 | Bassett, Jr. et al. | 219/467 |
| 3,910,537 | 10/1975 | Laboue et al. | 248/68 CB |

FOREIGN PATENT DOCUMENTS

| | | | |
|---|---|---|---|
| 2819118 | 10/1979 | Fed. Rep. of Germany | 219/464 |

*Primary Examiner*—Volodymyr Y. Mayewsky

*Attorney, Agent, or Firm*—Frank P. Giacalone; Radford M. Reams

[57] ABSTRACT

This invention relates to electric heaters of the type consisting of a flat convoluted loop or coil adapted to be arranged in an opening in a cooktop and, more particularly, to a support system wherein means are provided for cushioning vibrations resulting from relative movement between the convoluted heater and the support system.

6 Claims, 3 Drawing Figures

NOISE ISOLATION MEANS FOR CONVOLUTED SHEATHED ELECTRIC HEATER

CROSS REFERENCE TO RELATED APPLICATION

This application is related to concurrently filed application Ser. No. 344,854, filed jointly in the names of Louis H. Fiztmayer and Joseph M. Connelly, and assigned to General Electric Company, the assignee of the present invention.

BACKGROUND OF THE INVENTION

Sheathed heating units of the type arranged in flat convoluted loops or coils are generally arranged on a support grid consisting of a plurality of radially disposed support arms. In some prior art units, each convolution of the heating coil has been anchored to each support arm. This is usually accomplished by means of upwardly extending pairs of tabs that are formed on the support arms. Each convolution of the heater is positioned between the tabs which grip the sheath of the heating element. This method of securing the heating coil does provide a unit that is free from vibration noises; however, it does not permit movement of the sheathed heater relative to the support grid as they expand and contract with temperature changes. This lack of movement between the support arms and heater creates stresses that can ultimately lead to heating unit failure. Further, this method also results in a relatively large amount of heat dissipation through the grid support structure and also results in distortions at each point of anchor between the heater and support arms that can lead to premature failure of the sheathed heating unit.

In other prior art units, the convoluted coil is secured to the support grid at selected locations. For example, in some instances, only the outer pass or convolution of the heating element is anchored to one of the support arms. Except for this single point of attachment of the heating element to the support grid, the convolutions of the heating element are free to move on the upper edges of the supporting grid as they expand and contract with temperature changes. While this arrangement solves the problem relating to heat dissipation through the support assembly, it does however result in noise created by vibrations between the sheathed heating unit and the support structure. These vibrations and, more particularly the resulting noise, are objectionable.

The combination of relatively thin vertical spider or arm members for supporting the heating element together with staking the heating unit at only one location of one arm presents a minimum heat sink potential and, accordingly, a relatively efficient heating unit. However, the unsupported heating element results in some objectionable noise levels generally caused by vibrations between the heating unit and the spider arms.

Accordingly, it is an object of the present invention to provide a sheathed heating unit that is efficient in operation and relatively free from noise caused by vibration between the heating coil and support structure.

SUMMARY OF THE INVENTION

The present invention relates to an electric cooktop heating unit assembly of the type employing a convoluted sheathed heating element. The sheathed heating element is arranged on a support frame including a plurality of support arms extending generally radially that are in turn supported in a flange formed in the cooktop. A pan having a body portion arranged beneath the support frame includes a flange that engages the cooktop. The support arms are generally thin members arranged vertically on edge. The sheathed heating element is supported on the upper edge portion of the support arms in a single plane. One pass of the convoluted sheathed heating element is secured to one arm of the support frame. A resilient thermal insulating pad means is positioned on the upper edge portion of the support arms so as to be interposed between the contact point of each pass of the convoluted sheathed heating element and its associated support arm. Each support arm is provided with a positioning member that extends through an opening in the pan which has a diameter that is larger than the dimension of the supporting member. The lower end of the support member is positioned in the cooktop in a manner that maintains positive contact between the support frame, pan and cooktop. The arrangement effectively cushions vibrations and thermally insulates the sheathed heater element from the support frame.

DESCRIPTION OF THE PREFERRED EMBODIMENT

Figure 1:
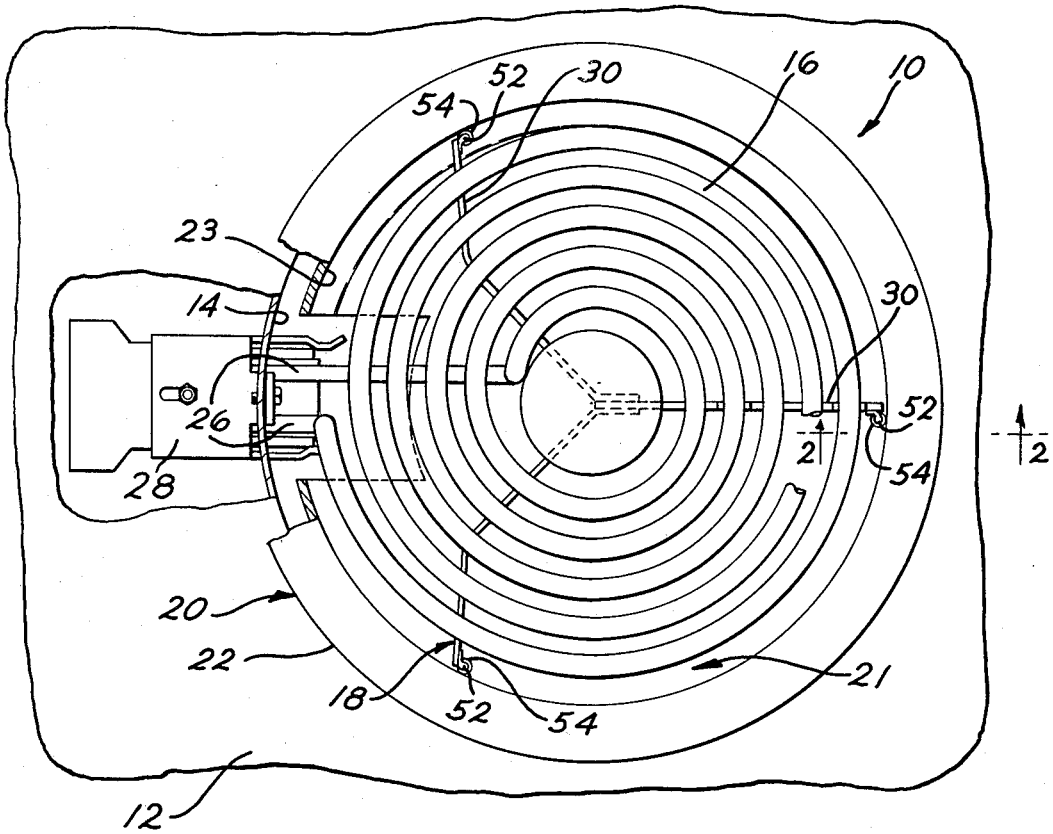
FIG. 1 is a top plan view of a surface heating unit embodying the present invention.
Figure 3:
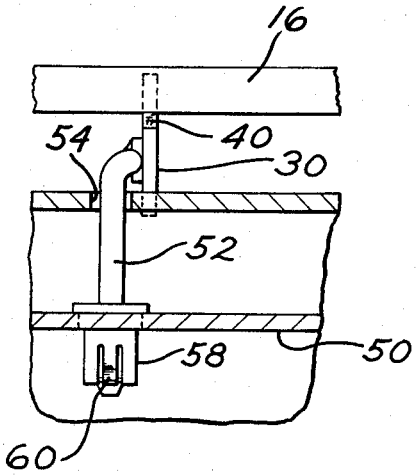
FIG. 3 is a fragmentary elevational view taken along line 3—3 of FIG. 2.
Figure 2:
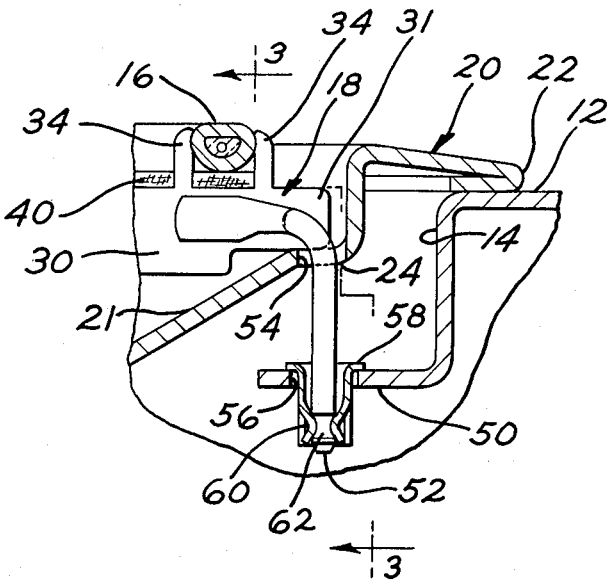
FIG. 2 is a fragmentary elevational view taken along line 2—2 of FIG. 1.

Referring to FIGS. 1 and 2 of the drawings, there is shown a heating unit assembly 10 adapted to be arranged in a top surface 12 of a cooking range. The surface 12 includes a circular opening 14 within which is located the heating unit assembly 10 embodying the present invention. The heating unit assembly 10 includes three main elements; namely, the metal sheathed heating element 16 that is wound into a flat coil or series of convolutions, an underlying supporting framework or grid 18, and a drip or reflector pan 20 which, as will be explained, is associated with the grid 18 for supporting grid 18 and assembly 10 from the edge of the circular opening 14 in the cooktop surface 12. The convoluted heating element 16 is of standard construction in that it has a central resistance element 17 (FIG. 2) arranged longitudinally and surrounded by a suitable electrical insulating material.

The reflector pan 20 is of a rather deep configuration and includes a body portion 21 dimensioned to be positioned in the opening 14 beneath the heating element 16 and its supporting grid 18. The upper perimeter of the reflector pan is formed to provide an outwardly extending support ring portion 22 which engages the surface 12 to support the heating unit assembly 10. Also formed in the body portion 21 of the pan 20 below the ring portion 22 is a ledge portion 24 that extends inwardly relative to ring portion 22.

The coiled heating element 16 is provided with a pair of parallel terminal end portions 26 extending radially from one side of the center of the coil and from one side of the outer pass of the coil. The portions 26 are not heated during operation of the heating element 16 and are secured within a terminal block 28.

The grid 18 in the present embodiment of the invention is formed to provide three diverging strip-like grid arms or members 30. The arms 30 are positioned vertically within the pan 20. The outer or distal ends 31 of the arms 30 are spaced generally 120° to each other. The convoluted turns of the heating element 16 as shown are mounted in a single plane on the upper edges of the grid arms 30. At least one pass of, or convolution of heating element 16 passing over one of the arms 30 is secured thereto. To this end, the upper edge of one of the arms 30 as shown in FIG. 2 is formed to provide a pair of spaced lugs 34 between which the outer pass of heating element 16 is arranged. The lugs 34 which are formed as an integral part of arms 30 are pressed over or toward each other and against the heating element so as to hold the heating element 16 relative to its associated arm 30 of the grid frame 18 through this single point.

The mounting between the heating element 16 and the grid arms 30 is usually in the form of a member similar to lugs 34 clamped or welded to the sheath of the heating element 16. Each point of contact between the heater 16 and the supporting grid 18 results in heat dissipating from the heater to the support frame, leading to loss of efficiency. Further, in practice, it has been found that such connections may damage the sheath during use such that, for example, the clamping element may bite into or rub on the sheath or, if a weld is employed it may tend to pull loose from the sheath and possibly rupture the sheath. In the present embodiment, the likelihood of heater sheath damage or loss of efficiency is diminished by having only one point in which the heating element 16 is secured to the spider. While this method of securing the heater to the grid at only one location minimizes damage and loss of heater efficiency, it does have the disadvantage in that vibrations result between the points of contact between the unattached convolutions of the heater and grid arms which lead to noise levels that are undesirable.

The noise producing vibrations are generally transmitted through the range which start as low frequency vibrations and manifest themselves as long duration high frequency vibrations between the heater 16 and support arms 30. The noise causing vibrations transmitted to the heater assembly 10 can be generated by any one of a number of household appliances, as for example, a refrigerator that usually is located in close proximity to the range. The refrigerator compressor has a frequency of approximately 60 CPS, while the natural resonance of frequency of the cooktop may be 30 CPS. However, it should be noted that the frequency of the heater may be in the 2,000 cy. range.

Means fully disclosed in the aforementioned application, Ser. No. 344,854, are provided which eliminate the noise generally associated with these vibrations and further increase the efficiency of the heating element by providing insulation between the heating element 16 and its associated support structure. To this end, the heating unit assembly 10 and grid support pan 20 are thermally isolated from the cooktop 12 by the use of resilient, thermally insulating isolating elements. In carrying out the present invention the resilient thermally insulating material employed was 304 stainless ASTM in a woven or spun state having a thickness of between 0.0625" and 0.125". The material may be obtained from several suppliers, one being METEX Co. under the item number DEV. 13712. It should be noted however that other materials may be available to accomplish the desired results. The resilient thermally insulating material used most also be immune to damage by acid and other materials and temperature of approximately 1400° F. that may be encountered during the cooking procedure. Since the vibrations are transmitted through the range it may be necessary to apply the isolating means at several points in the structure; however, it should be noted that the higher frequency vibrations, and the most objectionable, are those generated between the heating element 16 and the grid arms 30. Accordingly, in the present instance thermal isolating means is applied relative to the heating element and grid arms.

The resilient thermally insulating means employed includes a resilient thermally insulating element 40 that, as shown in FIG. 2, is positioned between each pass or convolution of the heating element 16 and the point of contact on the upper edge portion of each of the arms 30. The element 40 in this position may be a thin strip having substantially the same dimension as the width of the arm 30, and may be secured to the arm by any suitable means such as an adhesive or by welding that can resist damage by the materials encountered during the cooking procedure and also the temperature attained by the heating element in the range mentioned above. This location of element 40 effectively isolates the heating element 16 from both vibration and heat transfer between the support grid 18 and unconnected convolutions of the heating element 16. The element 40 eliminates the longer duration higher frequency vibrations between the grid arms 30 and the heater element 16. The thickness of the elements 40 employed should be sufficient to dampen coil vibrations while not creating hot spots that are generally caused when heat is not dissipated. As noted above, most of the objectionable noise is generated by the higher frequency vibrations between the heater element 16 and its associated support. Since other heating unit configurations may present different methods of supporting the heating unit relative to the range and, accordingly, different paths of contact between the range and heating element 16, the exact positioning of the isolating elements may vary. However, it should be noted that the relatively loosely held heating element 16 should be isolated relative to its associated support in order to effectively eliminate the longer duration high frequency vibrations therebetween.

In accordance with the present invention, means are provided in combination with element 40 for arresting the lower frequency vibrations generating through the range. With the heating element 16 isolated from grid 18, any low frequency vibrations generated through the range may result in objectionable noise at the contact point between the pan 20 and cooktop 12 and also between the arms 30 and pan 20. To this end, by the present invention, the grid framework 18 together with the heating element 16 attached thereto of the heating unit assembly are sandwiched and secured to the cooktop 12.

With reference to FIG. 2, it will be seen that the opening 14 in the cooktop 12 is formed with an inwardly extending, circumferentially disposed support flange 50. The flange 50 is dimensioned to extend partially beneath the body portion 21 of the pan 20 to a position that underlies the radial end portion of the arms 30. Secured to the radial end portion 31 of each of the arms 30 is downwardly extending support or positioning member 52. The positioning members 52 in the present instance are welded to their respective support arm 30; however, the member 52 can be formed as part of the arm 30. The shoulder 24 of pan 20 is provided with opening 54 corresponding in number to the numbers 52. The openings 54 are dimensioned larger than the member 52 to provide easy passage of member 52 therethrough. The flange 50 of cooktop 12 is also provided with openings designated 56 which are in alignment with openings 54 in pan 20. Positioned in each of the openings 56 is fastening means 58. The fastening means 58 are provided with resilient holding means 60 that are dimensioned to securely grip the member 52. As shown in FIG. 2, with the member 52 located in the fastening means 58, the end portion 31 of the arms 30 are securely held against the flange 24 of pan 20, and at the same time the ring portion 22 of pan 20 is securely held against the cooktop 12. This arrangement prevents movement and, accordingly, vibrations between the pan 20 and cooktop 12, and between the grid 18 and the pan 20. In effect, the low frequency vibrations emanating through the range and the resulting noise caused thereby are arrested. To insure that the grid 18 and pan 20 are maintained in their secured position relative to the flange 24 and the cooktop 12, respectively, the element 52 is formed with a detent portion 62. As shown in FIG. 2, the holding means 60 of fastening means 58 snaps into the detent portion 62 of the positioning element 52 to insure that positive contact is maintained between ring portion 22 and the cooktop 12 and between the grid 18 and pan 20.

While in the present invention there is shown a support element 52 secured to each of the arms 30, it should be understood that a single support element may be provided. In this event, the element 52 would be located on the arm 30 diametric to the terminal block 28. The employment of only one element 52 aids in the positioning and alignment of the element 52 relative to the fastening means 58 since only one, rather than a plurality of elements, must be in alignment.

In summary, by the present invention, the combination of a resilient thermal isolation means provided between the heating element 16 and the support grid 18 securely fastens the grid and pan to the cooktop 12 where vibration between juxtapositioned elements has eliminated objectionable noise levels.

The foregoing is a description of the preferred embodiment of the apparatus of the invention and it should be understood that variations may be made thereto without departing from the true spirit of the invention as defined in the appended claims.

What is claimed is:

1. An electric cooking range having a cooktop formed with an opening including an inwardly extending flange portion for supporting a heating unit in said opening, comprising:

a sheathed heating element mounted in said opening, said heating element having convolutions disposed in a single plane defining a cooking surface;

a pan means including a body portion adapted to be positioned in said opening and a ring portion dimensioned for supporting said pan on said cooktop;

a support frame member arranged in said body portion of said pan means including a plurality of support arms extending generally radially being arranged vertically on edge, with the outer lower edge portion of said support arms being supported on said body portion of said pan means, and the heating element being supported on the upper edge in a single plane;

holding means on the upper edge of at least one of said support arms immovably securing the outer portion of said convoluted heating element to said at least one of said support arms;

positioning element on at least one of said support arms extending downwardly therefrom through corresponding aligned opening in said body portion of said pan for engaging said flange portion for positioning and rigidly sandwiching said pan means between said support frame and said flange portion for supporting said heating unit in said opening;

resilient thermal insulating pad means positioned on said upper edge of said support arms being interposed at the point of contact between said upper edge and said heating element to cushion vibrations and to thermally insulate said heater element from said support frame.

2. The electric cooking range recited in claim 1 wherein one of said positioning elements is on each of said plurality of support arms.

3. An electric heating unit including a convoluted heating element being adapted to be mounted in an opening in a cooktop including an inwardly extending flange portion for supporting said heating unit in said opening comprising:

a pan means including a body portion dimensioned to be positioned in said range top opening.

(a) a radially extending flange supported on said cooktop, and (b) a ledge portion formed in said body portion of said pan extending radially inwardly relative to said radially extending flange;

a support frame member including a plurality of support arms extending generally radially and being arranged vertically on edge and being supported at their radial end on the ledge portion of said pan, said convoluted heating element being supported on the upper edge of said support arms in a single plane;

holding means on the upper edge of at least one of said support arms immovably securing the outer portion of said convoluted heating element to said one of said support arms;

positioning element on at least one of said support arms extending downwardly therefrom through aligned openings in said ledge portion of said pan for engaging said flange for positioning and rigidly sandwiching said pan means between said support frame and said flange for supporting said heating unit in said opening;

resilient thermal insulating pad means positioned on said upper edge of said support arms being interposed at the point of contact between said upper edge of said support arms and said heating element to cushion vibrations and to thermally insulate said heater element from said support frame.

4. The electric heating unit recited in claim 3 wherein one of said positioning elements is on each of said plurality of support arms.

5. The electric heating unit recited in claim 4 wherein the ledge portion of said pan means is provided with openings aligned with said positioning elements, said opening being dimensioned to allow passage of said positioning elements, said radially extending flange being provided with openings aligned with said positioning element for receiving the end portion of said positioning element.

6. The electric heating unit recited in claim 5 wherein fastening means are arranged in the openings in said radially extending flange for securely holding said positioning element in a position that maintains said support arms against the ledge portion of said pan means and the flange of said pan against said cooktop to prevent vibrations therebetween.

* * * * *